US007322073B2

(12) United States Patent
Cuisinier

(10) Patent No.: US 7,322,073 B2
(45) Date of Patent: Jan. 29, 2008

(54) Z-SHAPED WATER BALLOON CLIP

(76) Inventor: Jarret P. Cuisinier, 150 Almendral Ave., Atherton, CA (US) 94027

( * ) Notice: Subject to any disclaimer, the term of this patent is extended or adjusted under 35 U.S.C. 154(b) by 0 days.

(21) Appl. No.: 11/050,207

(22) Filed: Feb. 3, 2005

(65) Prior Publication Data

US 2005/0210639 A1 Sep. 29, 2005

Related U.S. Application Data

(60) Provisional application No. 60/556,934, filed on Mar. 26, 2004.

(51) Int. Cl.
*A63H 3/06* (2006.01)

(52) U.S. Cl. ..... 24/30.5 S; 446/222

(58) Field of Classification Search ..... 24/30.5 S, 24/563; 446/220, 222
See application file for complete search history.

(56) References Cited

U.S. PATENT DOCUMENTS

| | | | | |
|---|---|---|---|---|
| 2,396,906 A | | 3/1946 | Windson | |
| 4,380,103 A | | 4/1983 | McGrath et al. | |
| 4,760,624 A | | 8/1988 | Fish | |
| 4,914,789 A | * | 4/1990 | Pedersen | 24/30.5 S |
| 5,109,576 A | * | 5/1992 | Teekell et al. | 24/30.5 R |
| 5,799,377 A | | 9/1998 | Carroll et al. | |
| 5,987,708 A | * | 11/1999 | Newton | 24/30.5 S |
| 6,626,660 B1 | * | 9/2003 | Olson et al. | 425/190 |
| 2003/0136703 A1 | * | 7/2003 | Jones et al. | 206/554 |

FOREIGN PATENT DOCUMENTS

| | | | |
|---|---|---|---|
| GB | 2379619 A | * | 3/2003 |

* cited by examiner

*Primary Examiner*—James R. Brittain

(57) ABSTRACT

A water balloon clip that provides a quick, easy, and low-cost means for sealing a balloon orifice. For example, the water balloon clip may comprise a first slit and a second slit and together the slits comprise a substantially Z-like shape. A user may then seal a balloon by inserting the balloon neck in the first slit and then tucking the balloon neck into the second slit.

9 Claims, 5 Drawing Sheets

Z-SHAPED WATER BALLOON CLIP

CROSS-REFERENCE TO RELATED APPLICATIONS

This application claims priority to U.S. Provisional Patent Application Ser. No. 60/556,934 entitled "Z-Shaped Water Balloon Clip" and filed on Mar. 26, 2004 which is incorporated herein by reference.

FIELD OF INVENTION

This invention relates to balloon orifice sealing, and more particularly, to sealers such as water balloon clips.

BACKGROUND OF THE INVENTION

The use of clips to seal balloons has long been known to the prior art. These clips come in a variety of forms but often comprise hinged walls with a locking mechanism, thereby permitting a balloon neck to be closed within the locked walls. Alternatively, the prior art has disclosed a variety of disc embodiments, generally comprising a disc with slits along its edges. Accordingly, a balloon neck is wrapped around the disc via the slits in a manner so as to seal the balloon orifice shut. Unfortunately, however, a balloon can often escape this seal via movement in a direction parallel to the slits. This problem is especially prevalent when these embodiments are used with water balloons, which under the increased weight of their load tend to move more frequently and with greater force. Furthermore, use of these disc closers with water balloons is additionally problematic when used in combination with water balloon launchers (e.g. slit water balloon launchers), which increase balloon movement and place additionally friction on the balloon clip.

To combat the problems of straight-slit disc clips, high-friction clips (e.g. clips having fine slit teeth) and zigzag clips have been disclosed in the adjacent prior art of closing plastic bags. These bag clips have a high-friction slit or a zigzagging slit that is more resistant to exit by the bag neck. However, these high-friction and zigzag clips have several inherent shortcomings when used with balloons. First, these clips are very difficult to use as the balloon neck must be inserted through an especially narrow high-friction or zigzagging passageway. Therefore, the same barriers that make it difficult for the balloon neck to escape while inserted, also make it difficult to insert the balloon neck into the slit and to apply the clip. In fact, using these clips can actually be more difficult and time-consuming than actually tying a knot along the water balloon neck. As a result, these clips have not been adopted in the balloon market.

In addition, clips having high-friction and zigzagging slits have a much greater chance of tearing the balloon neck. Indeed, inserting the balloon neck through this high-friction area increases the likelihood of rupture along the neck lining. Furthermore, every time the balloon neck passes through one of the multiple zigzagging turns it comes in contact with a sharp point that can tear the lining of the neck.

In addition to the problems related to high-friction and zigzag clips, particular problems arise when adapting the prior art clip designs to specific use with water balloon clips. Using such clips with water balloons places a new set of constraints on the clip. For example, due to safety reasons these clips must have duller edges and corners. In addition, for safety reasons water balloon clips must be composed of different materials that are more pliable and lightweight. Hence, the design of water balloon clips must have higher strength to mass ratios while at the same time they must still be able to flex upon impact. The prior art balloon clips do not satisfactorily address these specific design issues relating to water balloon clip use.

Accordingly, a water balloon clip that is easy, painless, and quick to use for both children and adults is desirable. In addition, a water balloon clip that is less likely to tear the balloon neck is as well desirable. Additionally, a clip that is safer for use with water balloons and addresses the specific needs of sealing water balloons is also desirable. In addition, a design that works well with flexible materials is as well desirable.

SUMMARY OF THE INVENTION

The present invention provides a water balloon clip that is an easy, painless, and quick means for sealing a balloon orifice. Furthermore, the present invention provides a design that is not likely to tear the balloon neck and is optimized for specific and safe use with water balloons and flexible materials. In accordance with an exemplary embodiment of the present invention, a water balloon clip is configured to comprise two opposing slits, each slit further comprising a single kink. Subsequently, a balloon orifice can be sealed via the clip. For example, the water balloon clip may comprise two slits with inverted configurations that jointly form a Z-like shape. Thus, a user may insert the water balloon neck into the first slit past the kink of the first slit. Then, the user may insert the balloon neck in the second slit past the kink of the second slit, thereby pulling the neck of the balloon deeper into the first slit and effectively creating a water-tight seal that is resistant to balloon motion.

BRIEF DESCRIPTION OF THE DRAWINGS

Additional aspects of the present invention will become evident upon reviewing the non-limiting embodiments described in the specification taken in conjunction with the accompanying figures, wherein like numerals designate like elements, and.

DETAILED DESCRIPTION

The following descriptions are of preferred exemplary embodiments only, and are not intended to limit the scope, applicability, or configuration of the invention in any way.

Rather the following description provides a convenient illustration for implementing a preferred embodiment of the invention. Various changes may be made in the function and arrangement of elements described in the preferred embodiments without departing from the spirit and scope of the invention as set forth herein.

Generally, in accordance with an exemplary embodiment of the present invention, a water balloon clip is provided comprising two opposing slits, each slit further comprising a single kink. The water balloon clip is suitably configured to make the sealing of water balloons easier and quicker by means of the two opposing slits. For example, the water balloon clip may comprise two slits with inverted configurations that jointly form a Z-like shape. Thus, a user may insert the water balloon neck into the first slit past the kink of the first slit. Then, the user may insert the balloon neck in the second slit past the kink of the second slit, thereby pulling the neck of the balloon deeper into the first slit and effectively creating a water-tight seal that is resistant to balloon motion. Thus, by having two opposing slits with inverted configurations only one kink is required along each slit as the balloon neck is being pulled deeper into the first slit, away from the kink and exit of the first slit, via its insertion in the second slit. Moreover, it should be appreciated that any number of methods and motions that insert the balloon neck into the slits can be used while still falling within the scope of the present invention.

In accordance with an alternative embodiment of the present invention, the sharp-angled kink of the slit may also be suitably configured to be a curved kink. For example, the balloon clip may comprise two opposing slits with inverted configurations that jointly form an S-like shape.

Figure 1:
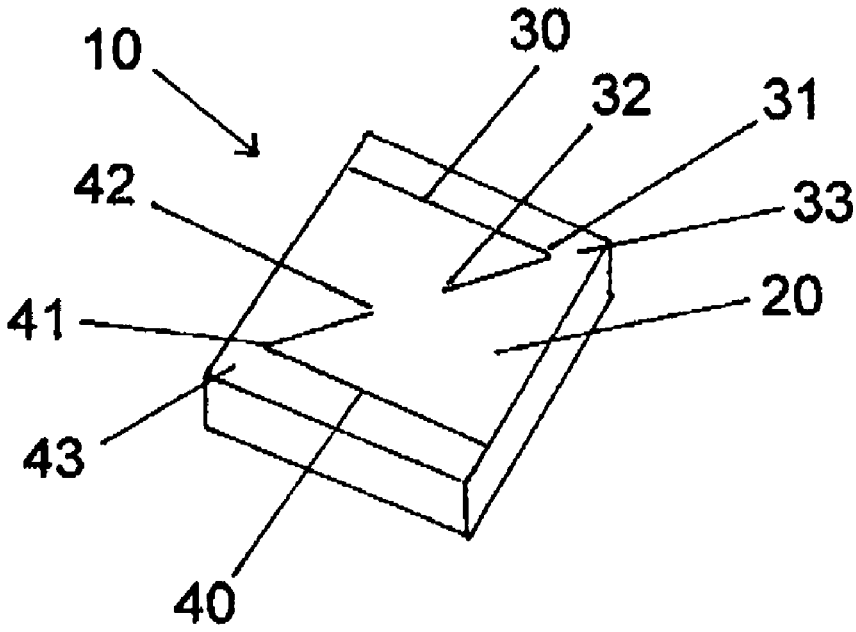
FIG. 1 is a perspective view of a preferred embodiment of the present invention having sharp-angled slits.

Thus, with reference to FIG. 1, in accordance with a preferred embodiment of the present invention, a water balloon clip 10 is shown comprising a body 20, a slit 30, and a slit 40. In accordance with the present preferred embodiment, body 20 is preferably composed of a material that is lightweight and suitably flexible, such as a rubber. However, in accordance with various alternate embodiments, body 20 may be substituted with heavier or less flexible materials and may as well be substituted with alternative materials and combinations of materials including plastics, clays, foams, composites, biodegradable "latexes", and the like. Moreover, body 20 preferably comprises a relatively rectangular shape with rounded edges and corners for augmented safety. Furthermore, preferably sides of body 20 comprise equal lengths, giving body 20 a substantially square shape. However, in accordance with various alternate embodiments of the present invention, body 20 may be configured to be circular, elliptical, or the like.

Additionally, body 20 may comprise slit-shaped forms that follow the joint outline of slit 30 and slit 40. Also, body 20 may comprise a texture for better gripping when wet.

In continuing reference to FIG. 1, and in accordance with a preferred embodiment, slit 30 and slit 40 further comprise a single kink 31 and a single kink 41, respectively. Furthermore, kink 31 and kink 41 are preferably configured to be sharp-angled as this sharp angle prevents a balloon from exiting clip 10. Specifically, preferably kink 31 and kink 41 are formed by linear slit segments that meet at single points. Additionally, in order to form a preferable "Z" shape, the inside angle of these kinks is preferably less than 90 degrees and greater than 0 degrees. In accordance with one aspect of a preferred embodiment, kinks 31 and kinks 41 comprise inside angles of about 45 degrees. However, in accordance with various alternate embodiments of the present invention, kink 31 and kink 41 may comprise alterative angles and alternative designs, including curved angles, right angles, and curved segments. Additionally, in accordance with one aspect of the present invention, slit 30 and slit 40 preferably each have an inner length and an outer length, which are separated by kink 31 and kink 41. In addition, in order to form a preferable "Z" shape, the outer lengths of slit 30 and slit 40 are substantially parallel to each other, as are the inner lengths of slit 30 and slit 40.

Additionally, in accordance with one aspect of the present invention, slit 30 and slit 40 are configured to have an end 32 and an end 42, respectively, and preferably end 32 and end 42 are proximate one another in an opposing fashion. Preferably, end 32 and end 42 are substantially collinear and are about 3 millimeters apart. However, in accordance with alternate embodiments of the present invention various alternate distances between end 32 and end 42 may be utilized. Additionally, slit 30 and slit 40 preferably have inverted patterns and thereby jointly configure the Z-like shape.

This "Z" shape is a preferable configuration for a variety of reasons. First, the inverted, opposing slit configuration makes possible that slit 30 and slit 40 only need to comprise a single kink 31 and a single kink 41, which is preferable to multi-kink zigzag clips as it is easier to use. For example, single kink 31 and single kink 41 along slit 30 and slit 40 make easier the insertion and removal of a water balloon relative to multi-kink zigzag clips and high-friction clips. Additionally, via use of the sharp-angled kinks of the Z shape the balloon neck is not likely to escape via balloon movement as the angles of kink 31 and kink 41 provide suitable catches. Furthermore, the Z shape most effectively utilizes the area of square body 20 as it leverages the diagonal of the shape of body 20, thereby maximizing the lengths of slit 30 and slit 40 before and beyond kink 31 and kink 41 and again reducing the likelihood of the balloon escaping, Similarly, this efficient use of space reduces the overall size necessary of body 20 and thereby decreases overall costs and increases product safety (by decreasing overall weight and footprint). In addition, the Z shape also has benefits in having high structural strength and high strength-to-mass ratios along slit 30 and slit 40 near end 32 and end 42 as both areas derive wall strength from triangular-shaped supports. This increased structural design strength is functionally critical as for safety reasons body 10 is preferably composed of light and pliable materials.

Additionally, the Z shape is also preferable because its inverted symmetry ensures that the balloon neck will be equally resistant to motion in all directions and gives the user an identical sealing experience no matter which slit he or she starts with. Finally, the Z shape flexes easily when an area 33 and an area 43 are lifted up or pushed down by the user, thereby allowing a user to easily insert a balloon neck into the deep portion of slit 30 and slit 40. However, because of structural benefits discussed above, when the balloon neck is inserted and area 33 and area 43 are relaxed, the Z-shaped slit 30 and slit 40 are resistant to spreading motions along the slit walls as well as to motions pulling the balloon neck away from end 32 and end 42.

Figure 2A:
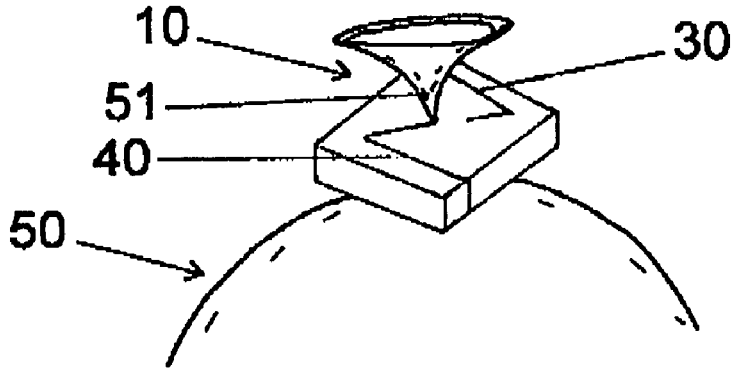
FIG. 2*a* is a perspective view of a preferred embodiment in the first step of sealing a water balloon neck in a preferred manner.
Figure 2B:
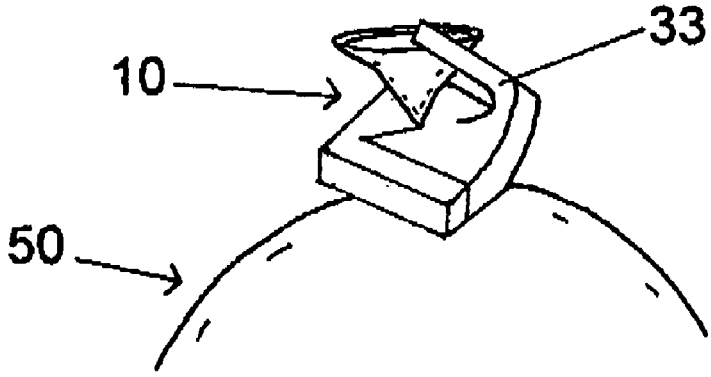
FIG. 2*b* is a perspective view of a preferred embodiment in the second step of sealing a water balloon neck in a preferred manner.
Figure 2C:
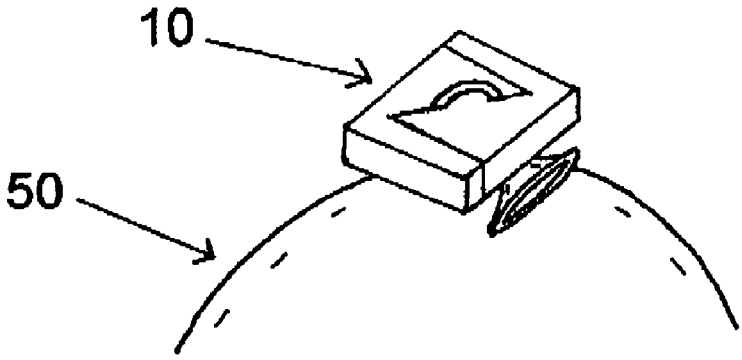
FIG. 2*c* is a perspective view of a preferred embodiment in the final step of sealing a water balloon neck in a preferred manner.

Thus, in accordance with a preferred embodiment of the present invention and now in reference to FIG. 2*a*, FIG. 2*b* and FIG. 2*c*, a water balloon 50 is suitably closed and sealed by water balloon clip 10. In use, a user preferably twists a balloon neck 51 two or three times until it becomes a condensed cylindrical volume. Twisted neck 51 is then inserted into slit 40 past kink 41 and proximate end 42. However, alternatively neck 51 may be first inserted into slit 30, reversing the process. With neck 51 inserted deep in slit 40, neck 51 is bent and area 33 is lifted by the user. The user then pulls balloon neck 51 deep into slit 30, which is exposed beyond kink 31 via the lifting of area 33. Once inserted deep in both slit 30 and slit 40, balloon 50 is sealed and the user may relax area 33. However, many alternate methods of use may as well be used to seal water balloon 50 via water balloon clip 10. For example, a user may choose not to lift area 33 and simply follow slit 30 with balloon neck 51.

Figure 3:
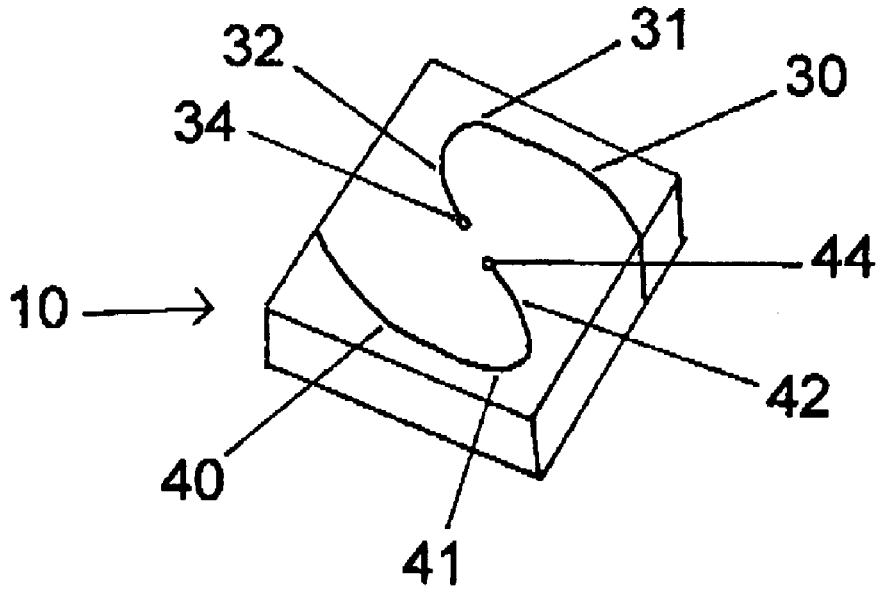
FIG. 3 is a perspective view of an exemplary embodiment of the present invention having curved slits.

Referring now to FIG. 3, in accordance with another alternate embodiment of the present invention, a curve-kinked embodiment is shown having an S-like shape. In accordance with another aspect of the present exemplary embodiment, end 32 and end 42 further comprise a small circular hole 34 and a small circular hole 44. Hole 34 and hole 44 help to prevent the tearing of slit 30 and slit 40 while balloon neck 51 is wedged deep in end 32 and end 42. Furthermore, hole 34 and hole 44 provide a place to contain twisted balloon neck 51, helping to reduce the chances of escape and reducing the stress placed on the walls of slit 30 and slit 40. Preferably, hole 34 and hole 44 have a diameter of about 1.5 millimeters.

Figure 4:
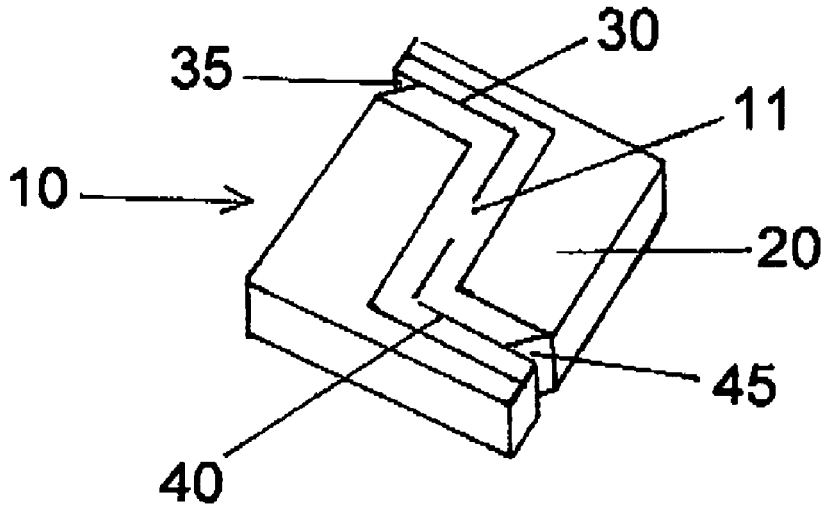
FIG. 4 is a perspective view of an exemplary embodiment of the present invention having right-angled slits.

Now with reference to FIG. 4, a square-kinked embodiment is shown. In accordance with another aspect of the present exemplary embodiment, slit 30 and slit 40 further comprise a mouth 35 and a mouth 45 to help aid the user in inserting balloon neck 51. Furthermore, body 20 proximate slit 30 and slit 40 further comprises colorings and a raised area 11 to highlight the slit location and aid the user in insertion of balloon neck 51. Additionally, and in accordance various alternated embodiments of the present invention, body 20 may further comprise a slot. This slot may be specially configured to allow balloon clip 10 and an attached balloon 50 to be received by a slit water balloon launcher at its slit via this slot. Then, the slit water balloon launcher may be used normally, launching the balloon and sealing clip together.

Figure 5:
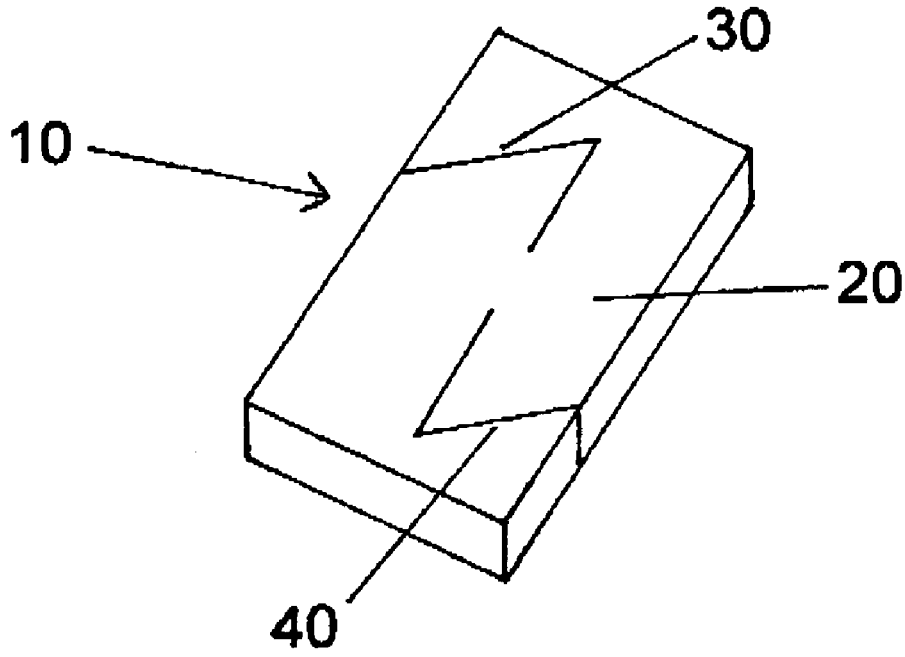
FIG. 5 is a perspective view of an exemplary embodiment of the present invention having a rectangular body; and, FIG. 6 is a perspective view of an exemplary embodiment having a slit-shaped body.

Referring now to FIG. 5, in accordance with another alternative embodiment of the present invention, body 20 is configured to be non-square rectangular shaped.

Figure 6:
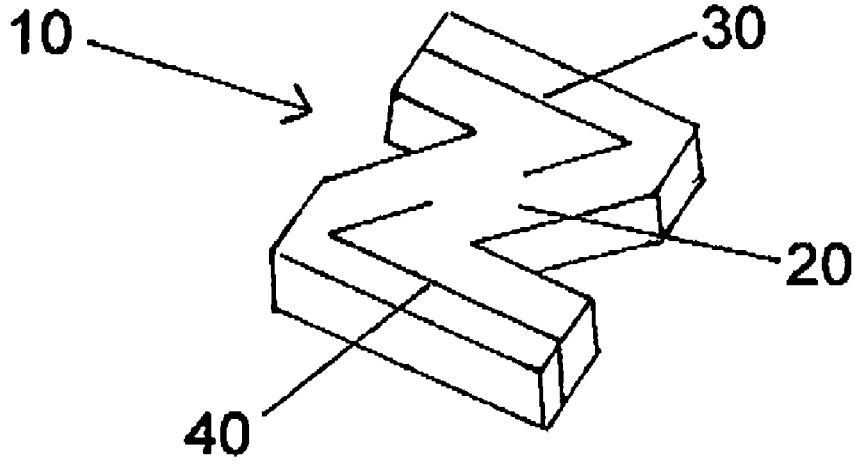

Now with reference to FIG. 6, a water balloon clip 10 comprising a slit-shaped body 20 is shown. In accordance with one aspect of the present invention, body 20 is Z-shaped to match jointly Z-shaped slit 30 and slit 40. However, body 20 may also be configured to match the slit shapes disclosed in FIG. 3 and FIG. 4 as well as others. Slit-shaped body 20 increases overall flexibility and thereby increases overall safety. Furthermore, slit-shaped body 20 decreases material mass and thereby decreases costs and weight, again increasing overall safety of water balloon clip 10.

Figure 7:
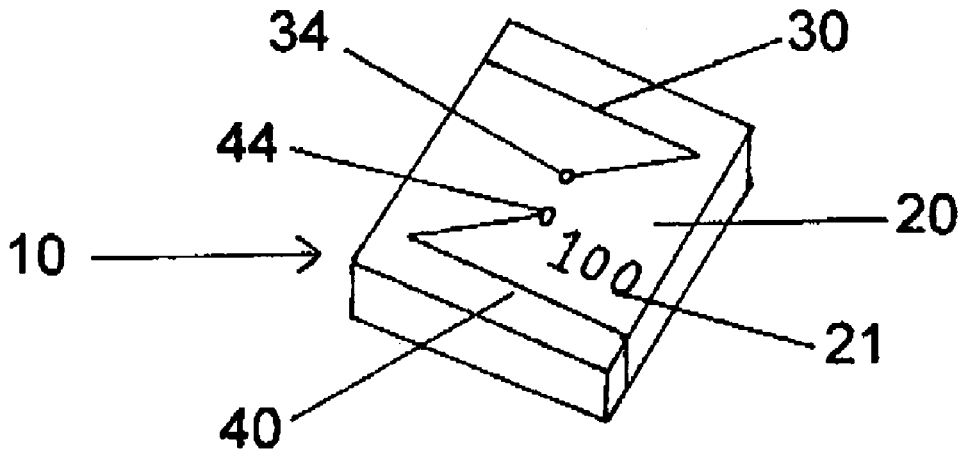
FIG. 7 is a perspective view of an exemplary embodiment having non-collinear slit ends.

Referring now to FIG. 7, in accordance with another alternative embodiment of the present invention, Z-shaped slit 30 and slit 40 have non-collinear ends. Additionally, an image 21 is present on body 20. In accordance with one aspect of the present invention, image 21 is present as a number. This number may then be used for score keeping in a variety of water balloon games. For example, different numbered clips could be used to seal various balloons and these numbers could be used to keep score with a target game. Additionally, different clips 10 could further comprise different colors corresponding with different images 21.

Thus, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. A balloon clip, comprising a body having an outer periphery, a first slit extending inward from a first point on said periphery above a horizontal centerline of said body to a second point past a vertical centerline of said body and at said second point said first slit extending substantially toward a centerpoint of said body, and a second slit extending inward from a third point on said periphery on a side of said body opposite said first point and below a horizontal centerline of said body to a fourth point past a vertical centerline of said body and at said fourth point said second slit extending substantially toward a centerpoint of said body, and wherein said slits together are substantially Z shaped.

2. The balloon clip of claim 1, wherein said first slit at said second point comprises a substantially sharp angle and said second slit at said forth point comprises a substantially sharp angle.

3. The balloon clip of claim 2, wherein said angles are about 45 degrees.

4. The balloon clip of claim 1, wherein said first slit at said second point comprises a substantially curved shape and said second slit at said forth point comprises a substantially curved shape.

5. The balloon clip of claim 1, wherein an area proximate said slits is raised.

6. The balloon clip of claim 1, wherein an area proximate said slits comprises a differentiating color.

7. The balloon clip of claim 1, wherein said clip further comprises a number on said body.

8. The balloon clip of claim 1, wherein said clip comprises a slot for reception by a slit water balloon launcher.

9. The balloon clip of claim 1, wherein said body comprises a shape substantially like a shape of said slits.

* * * * *